US011920252B2

(12) United States Patent
Joshi et al.

(10) Patent No.: US 11,920,252 B2
(45) Date of Patent: Mar. 5, 2024

(54) SU-8 ETCHING TECHNIQUE USING MOLTEN SALT

(71) Applicant: Toyota Motor Engineering & Manufacturing North America, Inc., Plano, TX (US)

(72) Inventors: Shailesh N. Joshi, Ann Arbor, MI (US); Gaurav Singhal, Champaign, IL (US); Paul Vannest Braun, Champaign, IL (US); Danny J. Lohan, Ann Arbor, MI (US); Kai-Wei Lan, Champaign, IL (US)

(73) Assignees: Toyota Motor Engineering & Manufacturing North America, Inc., Plano, TX (US); The Board of Trustees of the University of Illinois, Urbana, IL (US)

( * ) Notice: Subject to any disclaimer, the term of this patent is extended or adjusted under 35 U.S.C. 154(b) by 0 days.

(21) Appl. No.: 17/394,906

(22) Filed: Aug. 5, 2021

(65) Prior Publication Data

US 2023/0044483 A1 Feb. 9, 2023

(51) Int. Cl.
*C25D 1/20* (2006.01)

(52) U.S. Cl.
CPC ..... *C25D 1/20* (2013.01)

(58) Field of Classification Search
None
See application file for complete search history.

(56) References Cited

U.S. PATENT DOCUMENTS 9,873,833 B2 1/2018 Parris et al.
2012/0321952 A1* 12/2012 Kimura ..... H01M 4/80 205/78

OTHER PUBLICATIONS

Ning et al. "Holographic patterning of high-performance on chip 3D lithium-ion microbatteries", PNAS, 112, 21, 6573-6578, 2015. (Year: 2015).*

(Continued)

*Primary Examiner* — Stefanie S Wittenberg
(74) *Attorney, Agent, or Firm* — Christopher G. Darrow; Darrow Mustafa PC

(57) ABSTRACT

A method of decomposing a cured aromatic epoxy resin uses a molten salt bath at less than about 350° C. The molten salt bath includes a plurality of alkali metal hydroxides. The cured aromatic epoxy resin can be in intimate physical contact with a metal or alloy. The cured aromatic epoxy resin can be patterned by a lithographic method. The lithographic method can be multibeam interference lithography to form a three-dimensional photonic crystal template on a conductive substrate for electrodeposition of metal. Contacting the three-dimensional photonic crystal template with the electrodeposited metal with the molten salt bath can form a metal matrix device displaying a periodic pattern that is the inverse of the periodic pattern of the decomposed three-dimensional photonic crystal template.

16 Claims, 7 Drawing Sheets

(56) References Cited

OTHER PUBLICATIONS

Joye et al. "UV-LIGA microfabrication of 220 GHz sheet beam amplifier gratings with SU-8 photoresists", J. Micromech. Microeng, 20, 125016, 2010. (Year: 2010).*
English translation Pang et al. CN 106980239. (Year: 2017).*
Achchaq et al., "Characterization of Li2K(OH)3 as material for thermal energy storage at high temperature," The 13th International Conference on Energy Storage, Greenstock 2015, pp. 1-8 (8 pages).
Dentinger et al., "Removal of SU-8 Photoresist for Thick Film Applications," Sandia National Laboratories, 2002 (12 pages).

* cited by examiner

SU-8 ETCHING TECHNIQUE USING MOLTEN SALT

TECHNICAL FIELD

The present disclosure generally relates to a method to remove a cured patterned photoresist, or the like, by decomposition with a molten salt.

BACKGROUND

The formation of a three-dimensional photonic crystal provides a structure where, due to a favorable geometry of voids and mass of high refractive index, photonic band gaps can be prepared where light does not propagate in any direction. These photonic crystals have been developed with the goal of forming enabling devices for optical switching, sensors, filters, wave guides, or any other structure that function due to a universally connected structure with percolating pores throughout. These materials generally require features with dimensions on a nanometer or micrometer scale. One method to produce such materials is by holographic lithography or multibeam interference lithography, which generates features on micrometer and nanometer scales. Although multibeam interference lithography does not provide a flexibility and resolution often exhibited by other techniques, such as electron or ion beam lithography (EBL or IBL), superior patterning speeds and pattern coherences are observed at scales larger than about 10 nanometers.

In multibeam interference lithography, at least four laser beams are needed to generate the constructive and destructive interference patterns in a photoresist that upon development generate a three-dimensional pattern of voids and mass. Three-dimensional structures have been fabricated by a light activated polymerization of a negative photoresist. The polymerization occurs during a post-patterning baking process, as initiation without significant propagation occurs during the lithographic process. The typical structure that results is viewed as a periodic matrix of percolating pores throughout a solid resin, where the pattern of volumes having constructive amplification and destructive interference define the structure.

One application that these three-dimensional photonic crystals provide is a template for a device that cannot be directly formed but can exploit the periodic three-dimensional pattern within a layer. One such device is a heat sink device where the heat transfer material is a negative structure to the three-dimensional photonic crystal template. The difficulty in using the three-dimensional photonic crystal template is two-fold. The first problem is the conductivity of the three-dimensional photonic crystal template and the common substrates employed for generation of the template are typically not conductive, which makes processes, such as electroplating, challenging. The other difficulty involves the ability to remove the template and leave a negative structure of the three-dimensional photonic crystal template as the typical photoresist employed, SU-8 polymerizes and cross-links to a highly reticulated resin that is extremely difficult to remove.

Generally, methods of template removal from metals, with Ni used in micro-electro-mechanical system (MEMS), are carried out on relatively thin deposits with a simple pattern of lines and spaces from a photoresist. Removal of the SU-8 derived template can be carried out by pyrolysis. Typical pyrolysis of the resin requires temperatures greater than 600° C. Removal using molten salt baths such as $NaNO_3$/NaOH, generally require temperatures in excess of 300° C. and are generally vet oxidative. These molten salt baths remove cured SU-8 from Ni at about six μm per minute, or more than 90 minutes for a half millimeter simple line and space pattern. Temperatures of 300° C. or more can adversely affect the fine scale structural and mechanical properties of the deposited metal. Slow removal, at about one μm per minute, or more than eight hours for a half millimeter template, can be carried out by reactive ion etching (RIE) using a $CF_4$—/$O_2$ mixture. Downstream chemical etching (DCE) using high concentrations of $CF_4$ in mixtures with oxygen at about 250° C. allows removal at rates of about seven μm per minute, although the method is often damaging to semiconductors and can result in large oxide layers forming on metals tend to be detrimental to the properties of the metal. These methods are often not compatible with the device being generated. To this end, an effective method to remove a three-dimensional photonic crystal template at temperatures of about 350° C. or below is desirable for templates with complicated microstructures.

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

SUMMARY

This section provides a general summary of the disclosure and is not a comprehensive disclosure of its full scope or all its features.

In various aspects, the present teachings provide a method to consume a cured aromatic epoxy resin by degradation and dissolving the cured resin in a molten salt at temperatures below about 350° C. The molten salt differs from the typical oxidizing molten salts comprising nitrates or carbonates that interact with oxygen in the atmosphere to provide strong oxidizing reagent. The molten salt is a combination of two or more alkali metal hydroxides where the liquid state can be formed at temperatures above about 250° C. The molten salt can be a mixture of LiOH and KOH. The molten salt degradation can be carried out under an inert atmosphere without damage to a metal or alloy in intimate physical contact to the cured epoxy resin with decomposition and removal of the cured resin at a high rate and without significant oxidation to the metal or alloy. The cured epoxy resin can be a photoresist patterned by a lithography process to have a plurality of features that can be filled by deposition of a metal, such as electrodeposition, physical vapor deposition (PVD), or chemical vapor deposition (CVD).

In one aspect, the present teachings provide a method for forming a metal matrix device from a three-dimensional photonic crystal template by the degradation of the SU-8 derived resin patterned using multibeam interference lithography. These metal devices have percolating periodic structures that can have a density profile that is uniform, patterned, or gradient in structure, where the gradient can be in the thickness perpendicular to the substrate upon which the template was formed, or parallel to the substrate in the width or length of the device, or patterned in any manner parallel to the substrate. The method involves preparation of the template, metalizing the template by an electrodeposition process, and removing the template by degradation in a molten salt bath that is a combination of alkali metal hydroxides, such as lithium hydroxide and potassium hydroxide at temperatures below about 350° C.

In other aspects, the present teachings provide a metal matrix device suitable for use as a heat transfer media for heatsinks or other devices, where the metal or alloy has percolating voids throughout for optimization of heat transfer to a fluid in contact with the metal or alloy surface. The metal matrix can be of a metal with high thermal conductivity, such as copper, aluminum, gold, other metals, and alloys thereof. The metal matrix device has a continuous metal volume with a percolating continuous void volume through which a fluid can flow and absorb heat from the metal. The fluid can be air, an inert gas, water, or other liquid.

Further areas of applicability and various methods of enhancing the above coupling technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein.

Figure 1:
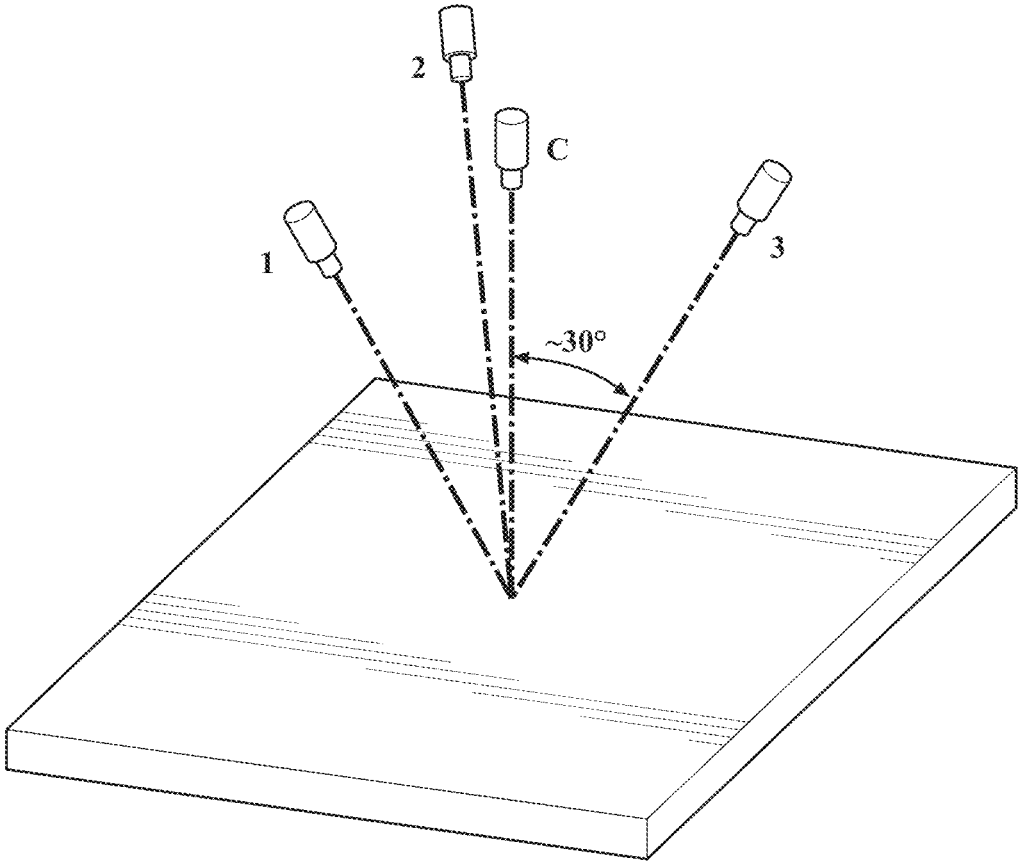
FIG. 1 illustrates an exemplary orientation of four laser beams, C, 1, 2, and 3 for a controlling step in a process for the generation of three-dimensional photonic crystal templates according to one aspect of the present technology.

It should be noted that the figures set forth herein are intended to exemplify the general characteristics of the methods, algorithms, and devices among those of the present technology, for the purpose of the description of certain aspects. These figures may not precisely reflect the characteristics of any given aspect and are not necessarily intended to define or limit specific embodiments within the scope of this technology. Further, certain aspects may incorporate features from a combination of figures.

DETAILED DESCRIPTION

The present teachings provide a method for decomposing a cured aromatic epoxy resin, such as a cured SU-8 resin. The decomposition is carried out in a molten salt bath. The bath promotes degradation of the resin at temperatures at or below about 350° C. The decomposition is carried out in a mixed alkali metal hydroxide, such as, but not limited, to mixtures of lithium and potassium hydroxides, where the mixed hydroxides can be in a liquid state above about 250° C. The molten salt bath allows a rapid reaction with the cured resin, such that a thickness of more than about 10 μm can be consumed per minute under an inert atmosphere. As the molten salt is relatively cool, and the process is carried out in the absence of air, oxygen, and moisture, the decomposition of the salt can be carried out in the presence of metals. The metals can be in intimate physical contact with the cured aromatic epoxy resin that can be patterned by a lithography process and where the metal is placed on the resin surface by electrodeposition, PVD, or CVD.

The present teachings also provide a method for forming a periodic metal matrix device by decomposing a cured SU-8 resin of a three-dimensional photonic crystal template that is infused with metal by a basic molten salt at temperatures of about 350° C. or below, under an argon or other inert atmosphere. For purposes of various embodiments, the substrate is advantageously a conductive substrate that can be used as an electrode for the electrodeposition of a metal within the void volumes of the three-dimensional photonic crystal template. The conductive substrate may be a reflective substrate, such as silicon or it can be a transparent substrate, such as indium tin oxide (ITO) glass. The metal can be copper, aluminum, gold, nickel, chromium, manganese, iron, cobalt, zinc, or any other metal, or any alloy that can be formed by electrodeposition. In various embodiments, the three-dimensional photonic crystal template has a periodic structure with void volumes where polymerization and crosslinking of SU-8 is not photoinitiated because destructive interference during the holographic lithography does not photolyze a photoinitiator in the photoresist composition of that volume. The three-dimensional photonic crystal template has cross-linked SU-8 resin situated in constructive volumes where the laser light did not experience destructive interference and much of which experienced a constructive amplification of the light in the volume to photolyze the photoinitiator in the photoresist composition and define the volumes where epoxy polymerization would gel the SU-8 monomer mixture. Upon dissolving a baked photoresist composition in the destructive volumes during a development step, the template is generated leaving only the constructive volumes as a highly reticulated polymer. This three-dimensional photonic crystal template is suitable for preparing periodic porous metallic structures by electroplating where the conductive substrate provides an electrode for the deposition of metal within the void volume of the three-dimensional photonic crystal template. As required, the three-dimensional photonic crystal template can be dried before any electrodeposition is carried out.

Removal of the three-dimensional photonic crystal template involves the degradation and dissolving of the cured SU-8 resin to remove the resin from the metal matrix device. The metalized three-dimensional photonic crystal template can be placed in a bath of molten LiOH and KOH at a temperature of about 350° C. or less. For example, the mixed salt of about 80 to about 85 mole percent potassium hydroxide becomes molten at about 250° C. This liquid mixture allows the degradation of the cross-linked SU-8 in less than a minute, for example, a copper matrix may be electrodeposited in a three-dimensional photonic crystal template and the resin can be completely removed after residing in the bath for about 10 seconds. The metal matrix device experiences little or no oxidation due to the molten salt degradation process.

To form the three-dimensional photonic crystal template, laser beams can be oriented in the manner illustrated in FIG. 1, where the central beam (C) is perpendicular to the substrate surface, with three other beams (1, 2, and 3) oriented with an angle of about 30° to beam C, and where beams 1, 2, and 3 are oriented at about 120° to each other. It should be understood that the arrangement of the beams of FIG. 1 is exemplary for illustrative purposes, and various other orientations of the beams can be employed to generate a pattern with a desired periodicity. In one embodiment, the intensity of beam C may be about 3.7 times the intensity of beams 1, 2, and 3, which may be of the same intensity. Generally, the beams are all in the same phase, being split from a single source beam. The path of beam C is such that the incident beam and reflected beam from the reflective substrate are co-linear and provide a near doubling of the intensity of the light along beam C's orientation that does not promote a reflection defect activation. The reflection of incident beams 1, 2, and 3 are generally of significantly lower intensity, allowing the defect photo-initiated active species to be of insufficient concentration to develop a cross-linked structure at a sufficient rate to form a defect during a subsequent development step. This orientation and differing beam intensities allows for a full development of the intended interference pattern that defines the three-dimensional photonic crystal template by using a very short beam dose period, for example, but not limited to about 0.3 seconds to about a minute of exposure.

In one aspect, the method does not require any modification of an established development protocol for initiation, polymerization, crosslinking, and developing to form the cured photoresist resin. A traditional process for forming and developing a photoresist is outlined in the flow chart provided in FIG. 2, beginning with the formation of an SU-8/photo acid generator solution. The solution is spin-coated and deposited as a layer on a substrate, with the solvent subsequently evaporated. The layer is exposed laser beams to generate an interference pattern of acid initiator. The method proceeds to a baking step to polymerize an SU-8 structure in the interference pattern. In various aspects, the pattern is developed in PGME to remove free SU-8 monomer. For example, the pattern is subsequently developed by dissolving unpolymerized volumes of the structure. This may be followed with supercritical drying steps to ultimately yield the photonic crystal.

The dosing rate can be varied to affect the amount of initiator generated, particularly with photoinitiators with a high quantum yield, such as, but not limited to, iron-arene salts, such as, cyclopentadienyl(fluorene) iron (III) hexafluorophosphate as a cationic initiator. Photoinitiators that do not act as thermal initiators at temperatures employed for deposition on the substrate or baking during development are advantageous. Other iron-arene salts that can be used include Irgacure 261, [Cp-Fe-Naph]$PF_6$, CFC, and CFA. Photoinitiators can be diaryliodonium salts and triarylsulfonium salts. The anion coupled to the cation of these photoinitiators can be, but are not limited to, triflate, tosylate, $PF_6^-$, $SbF_6^-$, and $BF_4^-$. A photosensitizer can be included with the photoinitiator. Useful photosensitizers include DIEF, RBAX, TIHF, Acridine Orange, and Erythrosin B. In this manner, the method is implemented by fine control of only one variable, the photonic dose, which can be controlled by the irradiation period, and does not require modification of the development steps where complicated multiple processes occur to define the resin volumes and void volumes.

Figure 2:
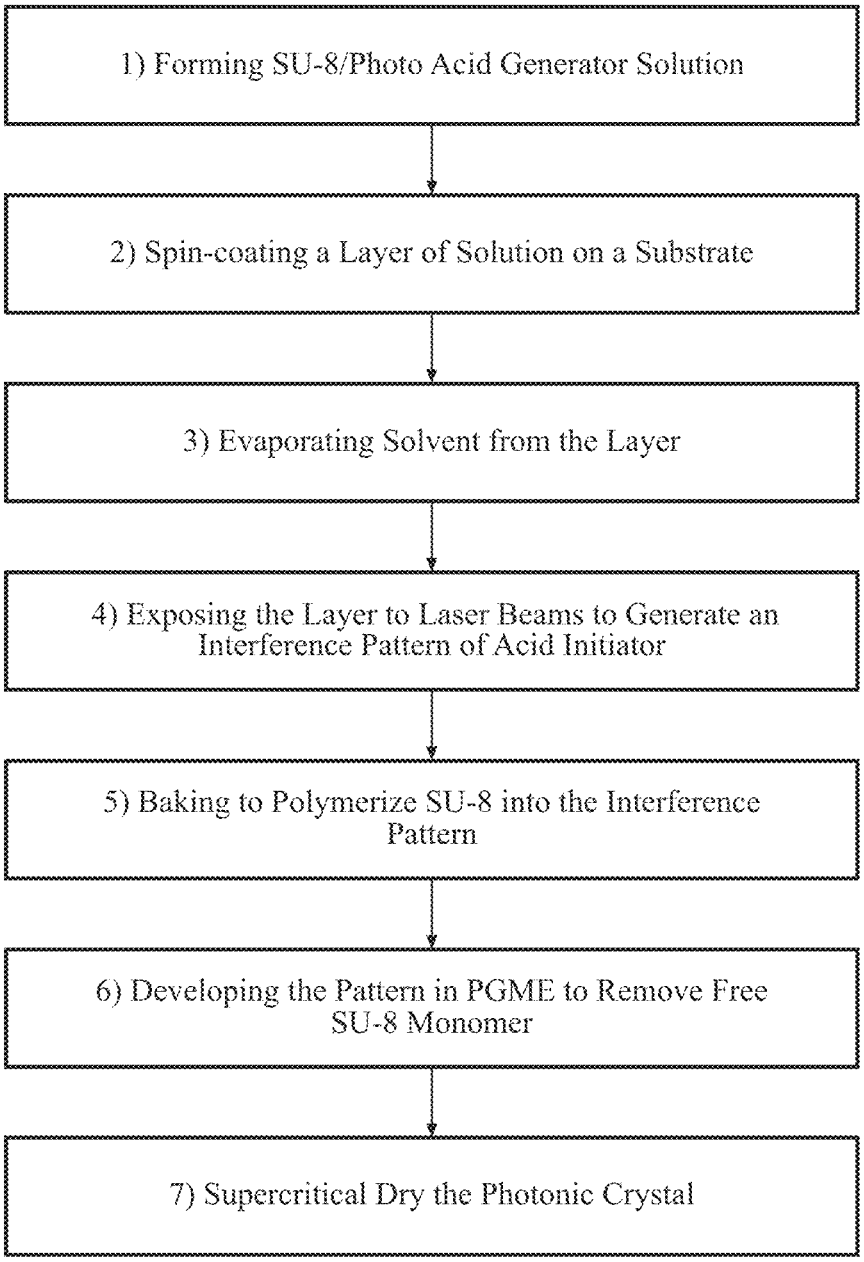
FIG. 2 is a flow chart of a production method to form a patterned photoresist according to one aspect of the present technology.

Portions of the process of FIG. 2 are graphically illustrated in FIGS. 3A-3D. FIGS. 3A-3D illustrate structure determining steps, and the outcome after exposing a homogeneously dispersed photoinitiator in a polyfunctional monomer to form a pattern of photo-released acid that, upon baking, forms a pattern of solid cross-linked polymer by acid initiation, and yields the photonic crystal by dissolution of unreacted monomer and photoinitiator.

Figure 3A:
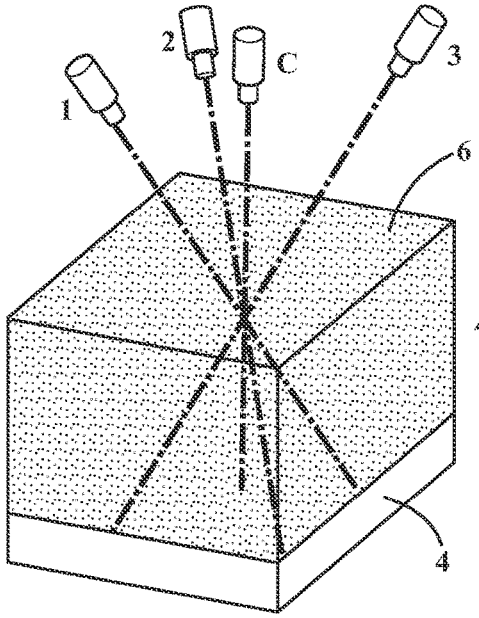
FIG. 3A is an example of the irradiation of a structure by laser beams, the structure including a reflective substrate with an SU-8 layer deposited thereon.
Figure 3B:
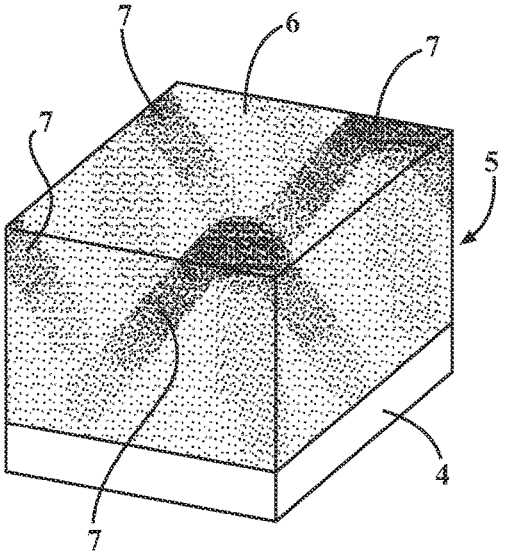
FIG. 3B is an example of the structure after irradiation, showing an irradiation-formed pattern of photogenerated acid.

The exemplary structure of FIG. 3A includes a reflective substrate 4 with an SU-8 layer 5 deposited thereon. The SU-8 layer 5 includes a dispersed or dissolved photoinitiator 6 in order to provide a photo curable resin layer. Notably, FIGS. 3A-3D illustrate the formation of a portion of a layer of the photonic crystal along the z-axis, and it should be appreciated that this pattern may be displaced in the x-y plane, repeated in an overlapping manner, and displaced along the z-axis multiple times to form the entire photonic crystal, depending only upon the orientations of the laser beams and thickness of the photo curable resin layer. FIG. 3A begins the patterning process, and provides an exemplary illustration of the irradiation by laser beams 1, 2, 3, and C on the surface of the SU-8 layer 5. The relative thickness of deposited SU-8 layer 5 and substrate 4 in FIGS. 3A-3D are not intended to limit the thickness of either layer, or their relative thickness. As shown in FIG. 3B, the irradiation forms a pattern of photogenerated acid 7 generally being leveled by reaction with an epoxy group of the SU-8 as an initiated, but not propagating in the glassy SU-8. The pattern of photogenerated acid 7 shown is exemplary in nature, and may begin with a gradient-like pattern with areas of different intensity, since the formation of photogenerated acid 7 generally occurs at locations where there is constructive interference of the beams, and the beam orientation may vary.

Figure 3C:
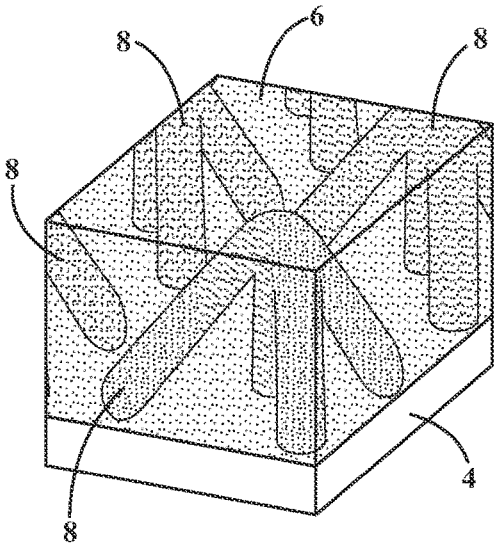
FIG. 3C is an example of the structure after baking, showing a volume of unreacted SU-8 monomer and photoinitiator remaining in a continuous periodic pattern contacting a complementary crosslinked polymer in a continuous periodic pattern.

The post irradiation processing is represented by the transition of FIG. 3B to FIG. 3C, and includes baking the exposed substrate and photoresist composition to a temperature of less than about 90° C. but more than about 75° C., such as about 85° C. Because the photogenerated initiator photolytically decomposes to, for example, a Lewis acid 7 that adds to the polymerizable functionality of the photoresist, for example, an epoxy functionality of SU-8, polymerization of the multifunctional monomer and crosslinking occur to form a solid mass of crosslinked polymer 8 filled constructive volumes of the templates. Temperatures greater than the desired temperature result in polymerization beyond the constructive volume, and temperatures less than the desired temperature do not permit significant polymerization in the glassy film. The time for post baking depends on the temperature employed, where higher temperatures require less time. After the baking and post baking, a volume of unreacted SU-8 monomer 5 and photoinitiator 6 remains in a continuous periodic pattern contacting a complementary a crosslinked polymer 8 continuous periodic pattern, as shown in FIG. 3C.

Figure 3D:
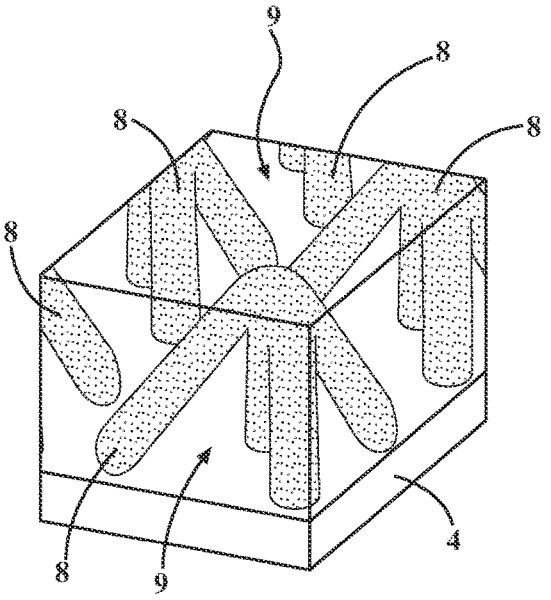
FIG. 3D is an example of the structure after dissolving of the monomer and non-crosslinked polymer, showing a pattern of connected voids residing within the three-dimensional photonic crystal template of cross-linked polymer from SU-8.

After baking, development continues with the dissolving of the monomer and non-crosslinked polymer in the destructive volumes that will generate the voids of the three-dimensional photonic crystal template. As shown in FIG. 3D, this results in a pattern of connected voids 9 residing within the three-dimensional photonic crystal template of cross-linked polymer 8 from SU-8. The dissolving of the non-crosslinked polymer in the destructive volumes will generate the voids of the three-dimensional photonic crystal template. As active centers remain in the cross-linked volumes, the temperature and diffusion of photoresist solution from the developing three-dimensional photonic crystal template are set for an optimal generation of the template. The solvent can be propylene glycol monomethyl ether acetate (PGMEA) or any other solvent such as acetone, cyclopentanone, and tetrahydrofuran. These solvents swell the crosslinked SU-8 resin and, for example, PGMEA can be desorbed to a large extent by placing the three-dimensional photonic crystal template in isopropanol.

To avoid structural collapse of the voids during a final drying of the three-dimensional photonic crystal template due to surface tension effects, drying can be carried out using supercritical $CO_2$ where the liquid-vapor interface is beyond the critical point. The wet three-dimensional photonic crystal template is placed in liquid $CO_2$ followed by heating past the critical point and releasing the pressure until ambient pressure and temperature is achieved. The resulting three-dimensional photonic crystal template is isolated with distinct constructive volumes of cross-linked photoresist polymer and destructive volumes void of condensed matter.

Modification of the irradiation profile during the formation of the three-dimensional photonic crystal template or by decorating the deposited photoresist surface with reflective or absorbing particles allows the formation of uniform, patterned or gradient periodic structures along any axis and bias the proportion of void volume in the template. This permits the formation of a metal matrix device that displays the negative of the template, where the void volumes result in the metal features and the resin features of the template generate the voids of the metal matrix upon degradation by the molten salt.

Figure 4:
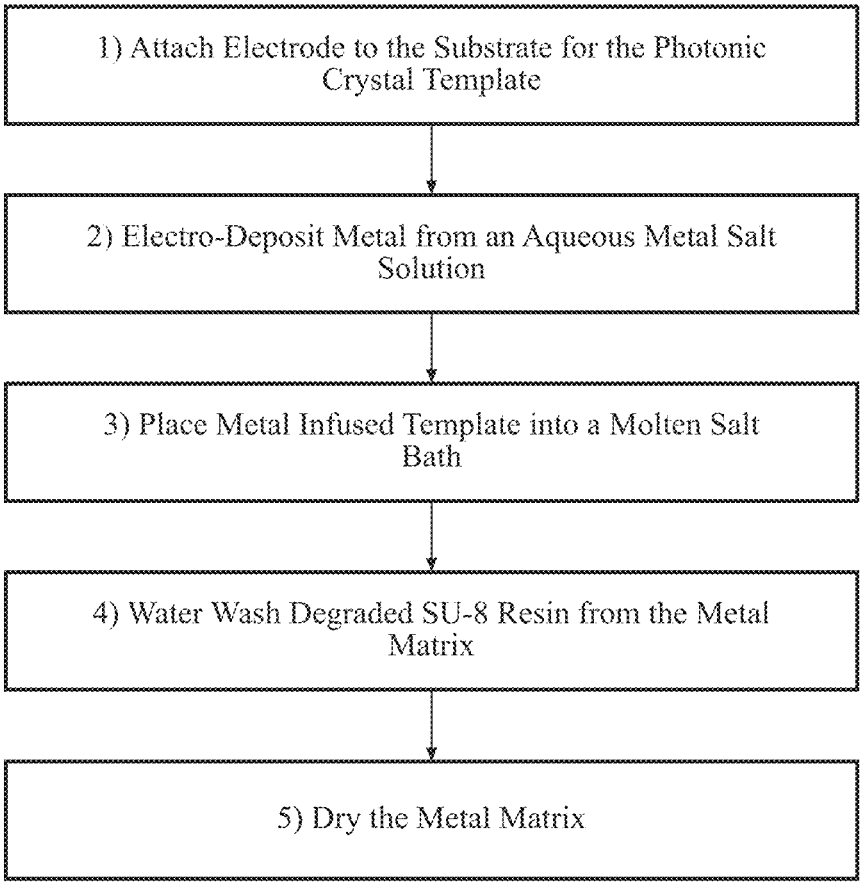
FIG. 4 is a flow chart of a production method to form a metal matrix, including: 1) attaching a template to an electrode, 2) electro-depositing metal, 3) degrading the template, 4) removing the degraded template, and 5) drying and isolating a metal matrix.

FIG. 4 outlines an exemplary process flow chart of the electrodeposition of a metal and degradation of the template that completes the preparation of a metal matrix. As outlined in of FIG. 4, the deposition of a metal to form a metal matrix may be carried out by electrically connecting an electrode to the conductive substrate of the template and placing that electrode in an electroplating solution that includes salts, for example, $CuSO_4$ and $H_2SO_4$ at a low pH at 25° C., and by applying a DC current with a current density of 10 mA/cm$^2$ or any current density that results in a potential greater than the plating potential of copper ions. The conductive substrate allows the migration of the electrolyte and its reduction within the void volume of the three-dimensional photonic crystal template. The surface of the deposited metal can be polished or otherwise modified to remove any undesired continuous metal over the templates surface distal to the substrate.

The metal infused three-dimensional photonic crystal template is placed in a hot molten salt bath for a short duration depending on the thickness of the template employed. The temperature is about 350° C. or less, and the salt may include a mixture of alkali metal hydroxides. The salt mixture can include salts other than hydroxides and other than alkali metals, where the salt is a weak or non-oxidizing mixture for the metal in the absence of air, moisture or any other oxidizing source at temperatures above about 250° C. An inert atmosphere is advantageous to avoid inhibition by carbon dioxide and other components of air. The molten salt bath promotes rapid degradation of cured aromatic epoxy resins, such as cured networks from SU-8 at 350° C. The degradation occurs with rates of at least about 10 μm per minute without significant metal oxidation. After removal from the molten salt, the surface of the metal matrix device can be washed with one or more of water, organic solvents, or mixed solvents capable of removing residual salt or degradation products. Organic solvents can include, but are not limited to, ethanol, acetone, isopropanol, toluene, or any mixture thereof. The metal matrix is then dried.

Figure 5A:
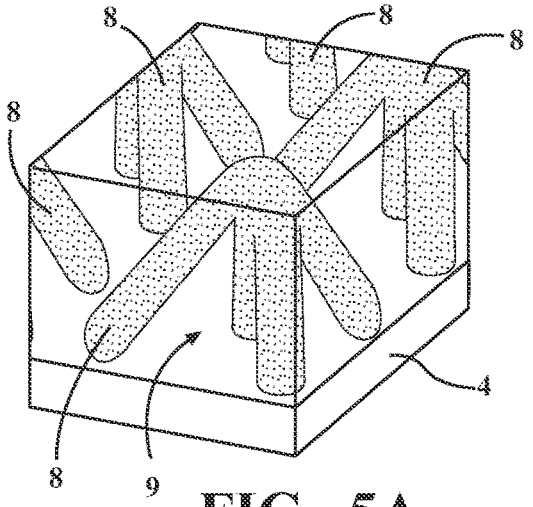
FIG. 5A is an example of a hypothetical three-dimensional photonic crystal template of cured resin on a conductive substrate.
Figure 5B:
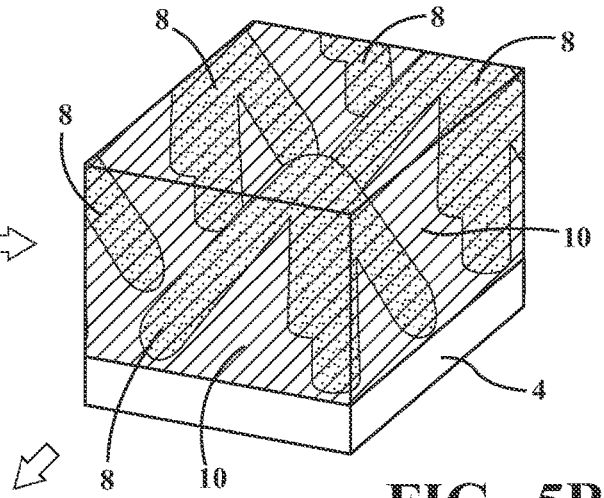
FIG. 5B is an example of the hypothetical three-dimensional photonic crystal template, showing the infusion of voids with a metal in an electro-deposition process.
Figure 5C:
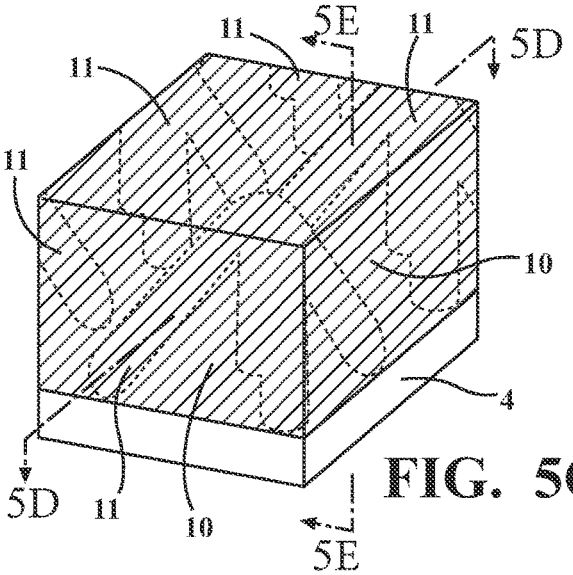
FIG. 5C is an example of the hypothetical three-dimensional photonic crystal template, showing a resulting metal matrix after the degradation of the photonic crystal template using the molten salt bath resulting in voids within the metal matrix.

For ease of illustration and appreciation, portions of the process of FIG. 4 are graphically illustrated in FIGS. 5A-5C. FIGS. 5A-5C illustrate schematic drawings of a hypothetical three-dimensional photonic crystal template of cured resin on a conductive substrate being infused with a metal in an electro-deposition process, followed by degradation of the photonic crystal template resulting in voids within a metal matrix.

Figure 5D:
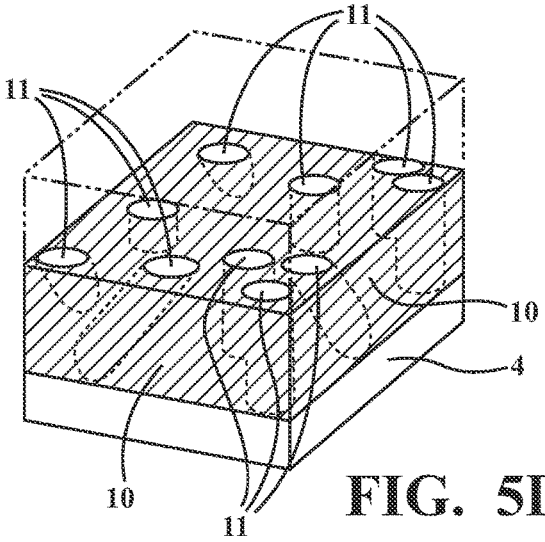
FIG. 5D shows a partial cut-away of the structure of FIG. 5C, viewed along the cut line 5D-5D in FIG. 5C.
Figure 5E:
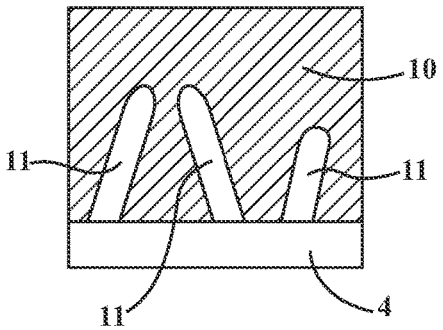
FIG. 5E shows a cross-sectional view of the structure of FIG. 5C, viewed along cut line 5E-5E in FIG. 5C.
Figure 5F:
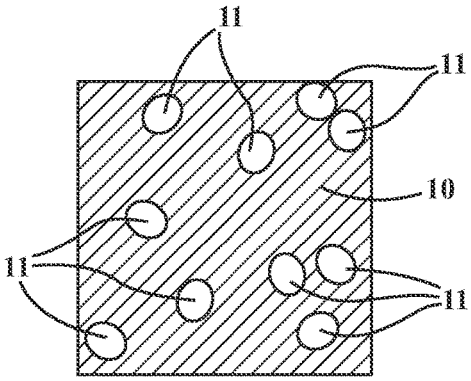
FIG. 5F shows a top plan view of the structure of FIG. 5D.

For example, FIG. 5A provides a schematic drawing of the hypothetical three-dimensional photonic crystal template of cured resin 8 on a conductive substrate 4 (which is carried over from FIG. 3D). FIG. 5B shows the infusion of the voids 9 of FIG. 5A with a metal 10, such as copper, that occurs after the electro-deposition process. FIG. 5C shows the resulting metal matrix after the degradation of the photonic crystal template using the molten salt bath, resulting in continuous voids 11 throughout the metal matrix. FIG. 5D illustrates a partial cut-away of the structure of FIG. 5C taken along the cut line 5D-5D in order to more clearly show the voids 11. FIG. 5E is a cross-sectional view of FIG. 5C taken along the line 5E-5E, and FIG. 5F is a top plan view of FIG. 5D.

It should again be noted that the structures shown in FIGS. 5A-5C may be layered and provided in a repeating or periodic pattern. For example, the cross-linked polymers 8 are provided adjacent one another such that they are in contact with one another and ultimately contacting the substrate 4. This allows the infusion of the metal 10 to ultimately form a continuous metal matrix, replacing the continuously extending voids 9.

Figure 6:
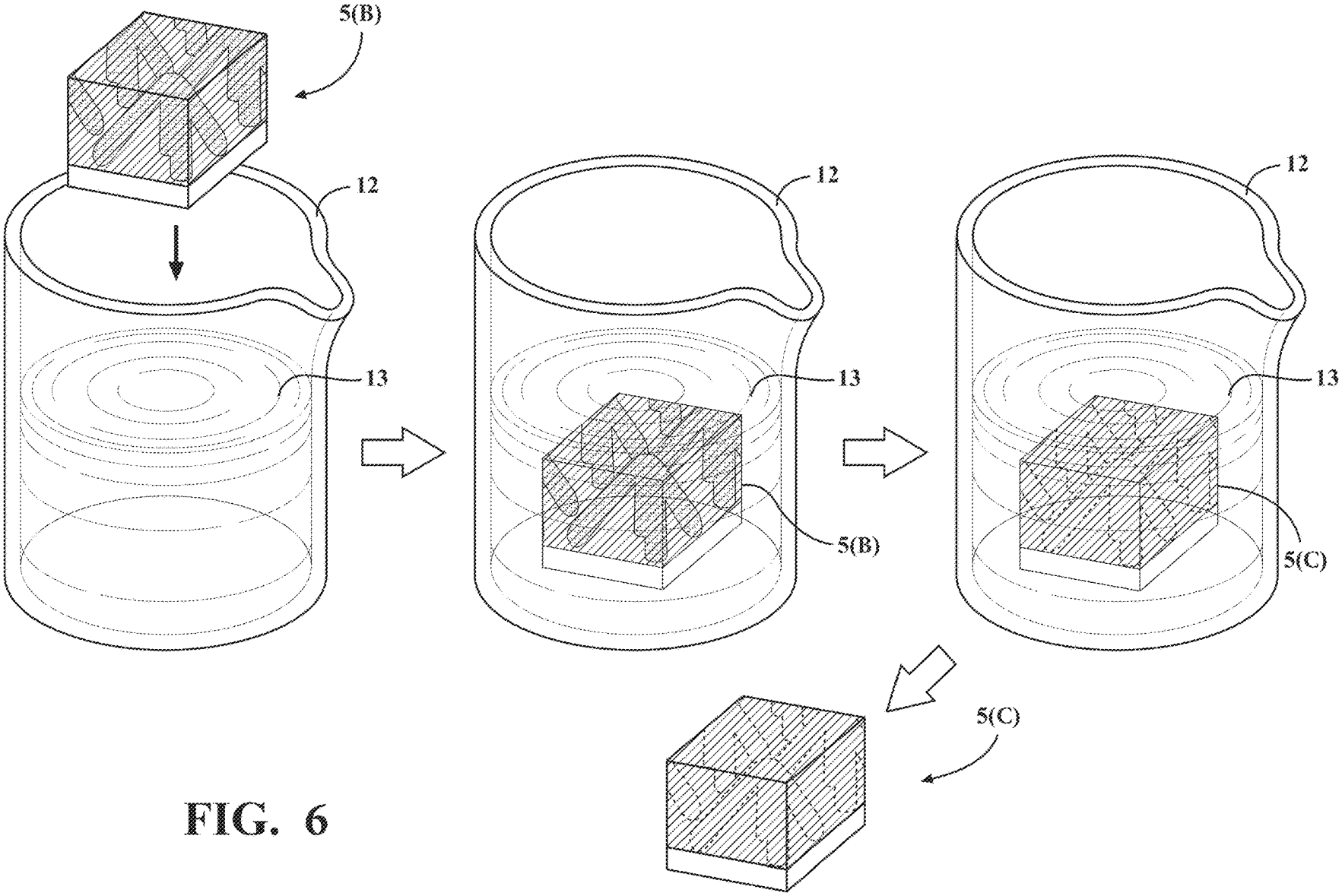
FIG. 6 is an exemplary representation of a metal infused photonic crystal template placed into a molten salt bath to degrade and dissolve the cured SU-8 resin.

FIG. 6 is an exemplary representation of the metal infused photonic crystal template of FIG. 5B being placed into a beaker 12 containing a hot molten salt bath 13 to degrade and dissolve the cured SU-8 resin 8, resulting in the representative structure shown in FIG. 5C.

Examples

Various aspects of the present disclosure are further illustrated with respect to the following Examples. It is to be understood that these Examples are provided to illustrate specific embodiments of the present disclosure and should not be construed as limiting the scope of the present disclosure in or to any particular aspect.

Methods

A diode pump solid state laser, Verdi 5 W (Coherent Inc.), a frequency doubled Nd:$YVO_4$ laser, was used at 532 nm for multi-beam interference lithograph. The Verdi 5 W laser has a maximum power of 5.5 W and a beam diameter of 2.25 mm with the beam expanded to as much as 9 mm using a spatial filter and sub-second exposure times. The optical platform employed a rigid table-top (Newport RS-4000) and pneumatic isolators (Newport I-2000) for vibration dampening. The beam was split into four beams and arranged by the mirrors into the umbrella geometry shown in FIG. 1. The power ratio of the beams was controlled by a polarizing cube beam splitter with a half waveplate situated before the splitter and additional half and quarter waveplates for adjusting the side and central beams, respectively, to yield a 3.7 to 1 intensity ratio of the central and side beams where the side beams are aligned at a 30° angle to the central beam.

The photoresist composition was SU-8, on average an octafunctional monomer, with cyclopentadienyl(fluorene) iron (III) hexafluorophosphate as photoinitiator and deposited as a solution in cyclopentanone and coated on an ITO glass slide. Solvent evaporation from the photoresist composition was carried out on a hot plate to a temperature of about 65° C. for ten minutes and about 95° C. for twenty minutes. After cooling to room temperature, exposure was restricted to 0.3 seconds using an electric shutter. After exposure, development was started with a bake at 85° C. for about twenty minutes to yield a three-dimensional photonic crystal template within a mass of uncured photoresist. After cooling to room temperature, PGMEA was used with gentle stirring to dissolve the destructive volumes and form the periodic structure of the three-dimensional photonic crystal template. Immersion of the template into isopropanol resulted in the extraction of residual PGMEA from the cured SU-8 resin. Supercritical drying was carried out by immersing the isopropanol wet SU-8 resin on the Si wafer in liquid $CO_2$ using a critical point dryer (Samdri 790) at about 0° C. and slowly heated through the critical point followed by slowly releasing the pressure to ambient and cooling to ambient temperature.

The electrodeposition of copper was carried out using the three-dimensional photonic crystal template from the developed SU-8 resin on the ITO glass, to give a copper infused and decorated three-dimensional photonic crystal template. The deposition of copper was carried out in an electroplating solution that includes $CuSO_4$ and $H_2SO_4$ at a low pH at 25° C. by applying a DC current with a current density of 10 $mA/cm^2$.

Figure 7:
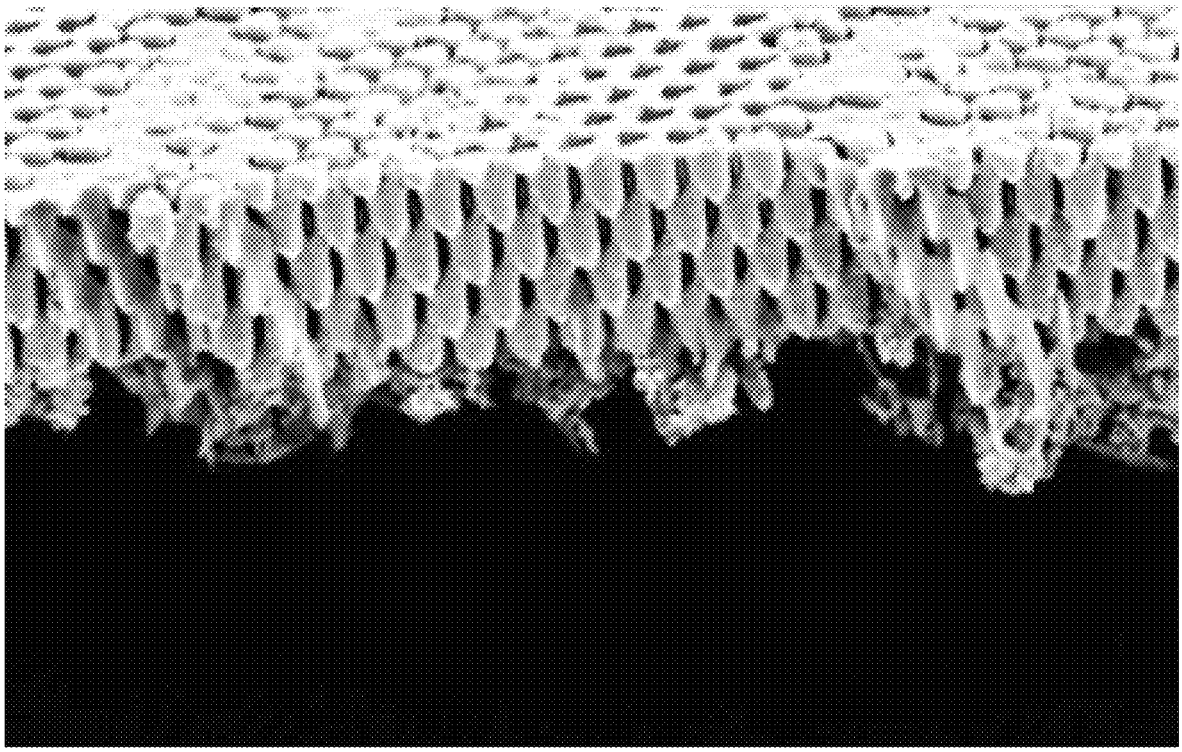
FIG. 7 is a scanning electron microcopy image of an exemplary copper matrix prepared from a three-dimensional photonic crystal template after degradation, washing, and removal of the cured SU-8 resin.

A molten salt bath was constructed using about a 1:4 LiOH:KOH molar ratio at about 350° C. in a stainless-steel crucible on a hot plate. The copper infused three-dimensional photonic crystal template on the ITO glass was dipped into the molten salt bath for ten seconds. Upon cooling the copper metal matrix device was washed with DI water to yield a metal matrix device. An SEM image of the metal matrix device is shown in FIG. 7, where the metal matrix is the inverse of the three-dimensional photonic crystal template, having been constructed within the voids of the template.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

As used herein, the term "about" includes exactly the term or number that it modifies and slight variations therefrom. "Slight variations therefrom" can include within 15 degrees/percent/units or less, within 14 degrees/percent/units or less, within 13 degrees/percent/units or less, within 12 degrees/percent/units or less, within 11 degrees/percent/units or less, within 10 degrees/percent/units or less, within 9 degrees/percent/units or less, within 8 degrees/percent/units or less, within 7 degrees/percent/units or less, within 6 degrees/percent/units or less, within 5 degrees/percent/units or less, within 4 degrees/percent/units or less, within 3 degrees/percent/units or less, within 2 degrees/percent/units or less, or within 1 degree/percent/unit or less. In some instances, "about" can include being within normal manufacturing tolerances.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. A method of preparing a metal matrix device, comprising:

performing multibeam interference lithography on a photoresist composition comprising an aromatic epoxy monomer and a photoinitiator deposited on a conductive substrate to form an interference pattern of constructive volumes and destructive volumes in the photoresist composition, thereby developing the photoresist composition to form a three-dimensional photonic crystal template having a periodic pattern of cured aromatic epoxy resin volumes and void volumes derived from the constructive volumes and destructive volumes;

depositing a metal on surfaces of the three-dimensional photonic crystal template by electrodeposition to form a metal matrix within the void volumes; and separating the metal matrix from the three-dimensional photonic crystal template by contacting the three-dimensional photonic crystal template with a molten salt comprising a plurality of alkali metal hydroxides at a temperature of about 350° C. or less, wherein the plurality of alkali metal hydroxides are at least two different alkali metal hydroxides selected from lithium hydroxide, sodium hydroxide, potassium hydroxide, and cesium hydroxide, the three-dimensional photonic crystal template decomposes and the metal matrix experiences substantially no oxidation.

2. The method of preparing a metal matrix device according to claim 1, wherein the molten salt is a mixture of lithium hydroxide and potassium hydroxide.

3. The method of preparing a metal matrix device according to claim 2, wherein a molar ratio of the potassium hydroxide to the lithium hydroxide is about four and the molten salt is not an oxidizing agent.

4. The method of preparing a metal matrix device according to claim 1, wherein the metal is copper, aluminum, gold, nickel, chromium, manganese, iron, cobalt, zinc, or any alloy thereof.

5. The method of preparing a metal matrix device according to claim 1, wherein the aromatic epoxy monomer is SU-8.

6. The method of preparing a metal matrix device according to claim 1, wherein the three-dimensional photonic crystal template has a uniform periodic pattern of void volumes or a gradient of void volumes.

7. The method of preparing a metal matrix device according to claim 1, wherein the molten salt is a mixture of lithium hydroxide and potassium hydroxide and a molar ratio of the potassium hydroxide to the lithium hydroxide is about four.

8. The method of preparing a metal matrix device according to claim 1, wherein the molten salt is not an oxidizing agent.

9. The method of preparing a metal matrix device according to claim 1, wherein contacting the three-dimensional photonic crystal template with the molten salt is under an inert atmosphere.

10. A method of preparing a metal matrix device, comprising:

performing multibeam interference lithography on a photoresist composition comprising an aromatic epoxy monomer and a photoinitiator deposited on a conductive substrate to form an interference pattern of constructive volumes and destructive volumes in the photoresist composition, thereby developing the photoresist composition to form a three-dimensional photonic crystal template having a periodic pattern of cured aromatic epoxy resin volumes and void volumes derived from the constructive volumes and destructive volumes;

depositing copper on surfaces of the three-dimensional photonic crystal template by electrodeposition to form a copper matrix within the void volumes; and separating the copper matrix from the three-dimensional photonic crystal template by contacting the three-dimensional photonic crystal template with a molten salt comprising a plurality of alkali metal hydroxides at a temperature of about 350° C. or less, wherein the plurality of alkali metal hydroxides are at least two different alkali metal hydroxides selected from lithium hydroxide, sodium hydroxide, potassium hydroxide, and cesium hydroxide, the three-dimensional photonic crystal template decomposes and the copper matrix experiences substantially no oxidation.

11. The method of preparing a metal matrix device according to claim 10, wherein the aromatic epoxy monomer is SU-8.

12. The method of preparing a metal matrix device according to claim 10, wherein the three-dimensional photonic crystal template has a uniform periodic pattern of void volumes or a gradient of void volumes.

13. The method of preparing a metal matrix device according to claim 10, wherein the molten salt is a mixture of lithium hydroxide and potassium hydroxide.

14. The method of preparing a metal matrix device according to claim 13, wherein a molar ratio of the potassium hydroxide to the lithium hydroxide is about four.

15. The method of preparing a metal matrix device according to claim 10, wherein the molten salt is not an oxidizing agent.

16. The method of preparing a metal matrix device according to claim 10, wherein contacting the three-dimensional photonic crystal template with the molten salt is under an inert atmosphere.

* * * * *